US010597919B2

(12) United States Patent
Schulte

(10) Patent No.: US 10,597,919 B2
(45) Date of Patent: Mar. 24, 2020

(54) DOOR HINGE

(71) Applicant: ECO Schulte GmbH & Co. KG, Menden (DE)

(72) Inventor: Tobias Schulte, Menden (DE)

(73) Assignee: ECO Schulte GmbH & Co. KG, Menden (DE)

( * ) Notice: Subject to any disclaimer, the term of this patent is extended or adjusted under 35 U.S.C. 154(b) by 0 days.

(21) Appl. No.: 15/781,788

(22) PCT Filed: Oct. 7, 2016

(86) PCT No.: PCT/EP2016/074013
§ 371 (c)(1),
(2) Date: Jun. 6, 2018

(87) PCT Pub. No.: WO2017/097457
PCT Pub. Date: Jun. 15, 2017

(65) Prior Publication Data

US 2018/0363343 A1 Dec. 20, 2018

(30) Foreign Application Priority Data

Dec. 11, 2015 (DE) ..... 10 2015 121 593

(51) Int. Cl.
*E05D 11/04* (2006.01)
*E05D 3/02* (2006.01)

(52) U.S. Cl.
CPC ..... *E05D 11/04* (2013.01); *E05D 3/02* (2013.01); *E05D 2003/025* (2013.01); *E05D 2003/027* (2013.01); *E05D 2011/045* (2013.01)

(58) Field of Classification Search
CPC ... E05D 11/04; E05D 11/02; E05D 2003/025; E05D 2003/027; E05D 2001/045; Y10T 16/537; Y10T 16/5377; Y10T 16/5379
See application file for complete search history.

(56) References Cited

U.S. PATENT DOCUMENTS 2,090,569 A * 8/1937 Bagley ..... E05D 7/0027 16/244
2,255,529 A * 9/1941 May ..... E05D 7/0018 16/240

(Continued)

FOREIGN PATENT DOCUMENTS

DE 2412725 A1 * 9/1975 ..... E05D 7/0027
DE 10361548 A1 7/2005

(Continued)

OTHER PUBLICATIONS

Int'l Search Report dated Jan. 12, 2017 in Int'l Application No. PCT/EP2016/074013.

(Continued)

*Primary Examiner* — Chuck Y Mah
(74) *Attorney, Agent, or Firm* — Panitch Schwarze Belisario & Nadel LLP

(57) ABSTRACT

A door hinge having inner and outer door hinge parts comprising fixing means (hinge plates) for mounting to the door frame and to the door. The outer door hinge part has two bearing portions fixedly connected by the fixing means, and the inner door hinge part has one bearing portion between the two bearing portions of the outer door hinge part. At least one bearing portion has a blind hole with a flat base, and a first cylindrical sliding cup element lies in the blind hole with its end face outer wall superficially on the base of the blind hole. The first sliding cup element has a ball socket-shaped wall containing a metal ball. A second cylindrical sliding cup element lies fully or partly in the blind hole and, on its end face facing the ball, has a concave ball socket-shaped wall lying superficially on the ball surface.

16 Claims, 5 Drawing Sheets

(56) References Cited

U.S. PATENT DOCUMENTS

| | | | | | |
|---|---|---|---|---|---|
| 2,618,010 | A * | 11/1952 | Helz | E05D 11/04 | 16/244 |
| 2,748,420 | A * | 6/1956 | Clover | E05D 7/02 | 16/265 |
| 5,930,868 | A * | 8/1999 | Butler | E05D 11/04 | 16/276 |
| 6,212,734 | B1 * | 4/2001 | Commons | E05D 7/0027 | 16/243 |
| 2006/0156512 | A1 * | 7/2006 | Naylor | E05D 5/127 | 16/273 |

FOREIGN PATENT DOCUMENTS

| | | | | |
|---|---|---|---|---|
| DE | 102009031829 | A1 | 1/2011 | |
| EP | 0170126 | A2 * | 2/1986 | B21K 13/02 |
| GB | 1451739 | A * | 10/1976 | E05D 11/02 |
| KR | 20060068720 | A * | 6/2006 | |
| KR | 101312585 | B1 * | 9/2013 | |

OTHER PUBLICATIONS

Written Opinion dated Jan. 12, 2017 in Int'l Application No. PCT/EP2016/074013.

* cited by examiner

DOOR HINGE

CROSS-REFERENCE TO RELATED APPLICATIONS

This application is a Section 371 of International Application No. PCT/EP2016/074013, filed Oct. 7, 2016, which was published in the German language on Jun. 15, 2017, under International Publication No. WO 2017/097457 A1, which claims priority under 35 U.S.C. § 119(b) to German Application No. 10 2015 121 593.4, filed Dec. 11, 2015, the disclosures of which are incorporated herein by reference in their entirety.

FIELD OF ENDEAVOR

The present invention concerns a door hinge.

BACKGROUND

Door hinges consist of a relatively high number of parts if they are to have a suitable mounting. A door hinge is known in which a ball lies between two sliding bearing elements. The sliding bearing elements are screwed into the bearing portions of the outer door hinge part, or held in position by screws. This door hinge consists of a disproportionately high number of parts, making assembly complex and costly.

A door hinge made of few parts and its production method are also disclosed in DE 102009031829 A1. This door hinge is distinguished in that the bearing portions of the outer door hinge part are made by turning or cold extrusion, and are closed on their outer end faces. On the end faces pointing towards the bearing portion of the inner door hinge part, the bearing portions of the outer door hinge part either have a protrusion which engages in a sliding element lying in the bearing portion of the inner door hinge part, or they have a recess on which the sliding element or a bolt-like part of the inner door hinge part lies. As FIG. 3 of DE 102009031829 A1 shows, the bases of the blind holes forming the recesses in the bearing portions of the outer door hinge part have a complex hemispherical form, which is awkward and costly to produce.

The object of the present invention is to refine the door hinge known from DE 102009031829 A1 such that no complex production of hemispherical bases in the blind holes is required.

SUMMARY OF ASPECTS OF THE DISCLOSURE

This object may be achieved by a door hinge with features as recited in one or more of the accompanying claims.

The door hinge according to the invention is distinguished in that it is composed of parts which are easy to produce. The bearing portions of the outer door hinge can be made easily from solid profiles or as turned parts in which a blind hole with as flat a base wall as possible is machined on the end face. The two sliding cup elements, in particular advantageously made of plastic, and the ball arranged in between (which advantageously may be made of a metal) are arranged in this blind hole, wherein the first sliding cup element lies on the base wall of the blind hole of the bearing portion.

The sliding cup elements have a ball socket-shaped bearing surface for the ball so that the large sliding surfaces result in little friction and hence low wear.

The bearing portion of the inner door hinge part with its two axial ends forms protrusions which each engage in the end face recess of a second sliding cup element and rest on its base walls which are as flat as possible. The elements are all formed rotationally symmetrically, so they can rotate about their axis relative to each other.

Evidently, it is also possible for the bearing portions of the outer door hinge part to have corresponding protrusions, like the bearing portion of the inner door hinge part described above, wherein then the bearing portion of the inner door hinge part must have corresponding blind hole bores in its end face, in which the sliding cup elements and the balls engage.

Also it is in the sense of the invention, when the bearing portion of the inner door hinge part has a protrusion on one axial end and a blind hole bore on the other axial end face, wherein then one bearing portion of the outer door hinge part must have a corresponding blind hole bore and the other bearing portion a corresponding protrusion.

After assembling the individual parts of the door hinge according to the invention, the bearing portions are connected to the hinge plates, possibly by a weld seam. On welding together, the bearing portions of the outer door hinge part must be pressed against each other, or pushed together and held such that the finished door hinge is free of play.

The balls and the sliding cup elements are advantageously made of different materials which together have good sliding properties.

BRIEF DESCRIPTION OF THE DRAWINGS

A possible embodiment of the door hinge according to the invention is explained below in more detail with reference to the drawings.

The drawings show.

DETAILED DESCRIPTION OF ASPECTS OF THE DISCLOSURE

Figure 1:
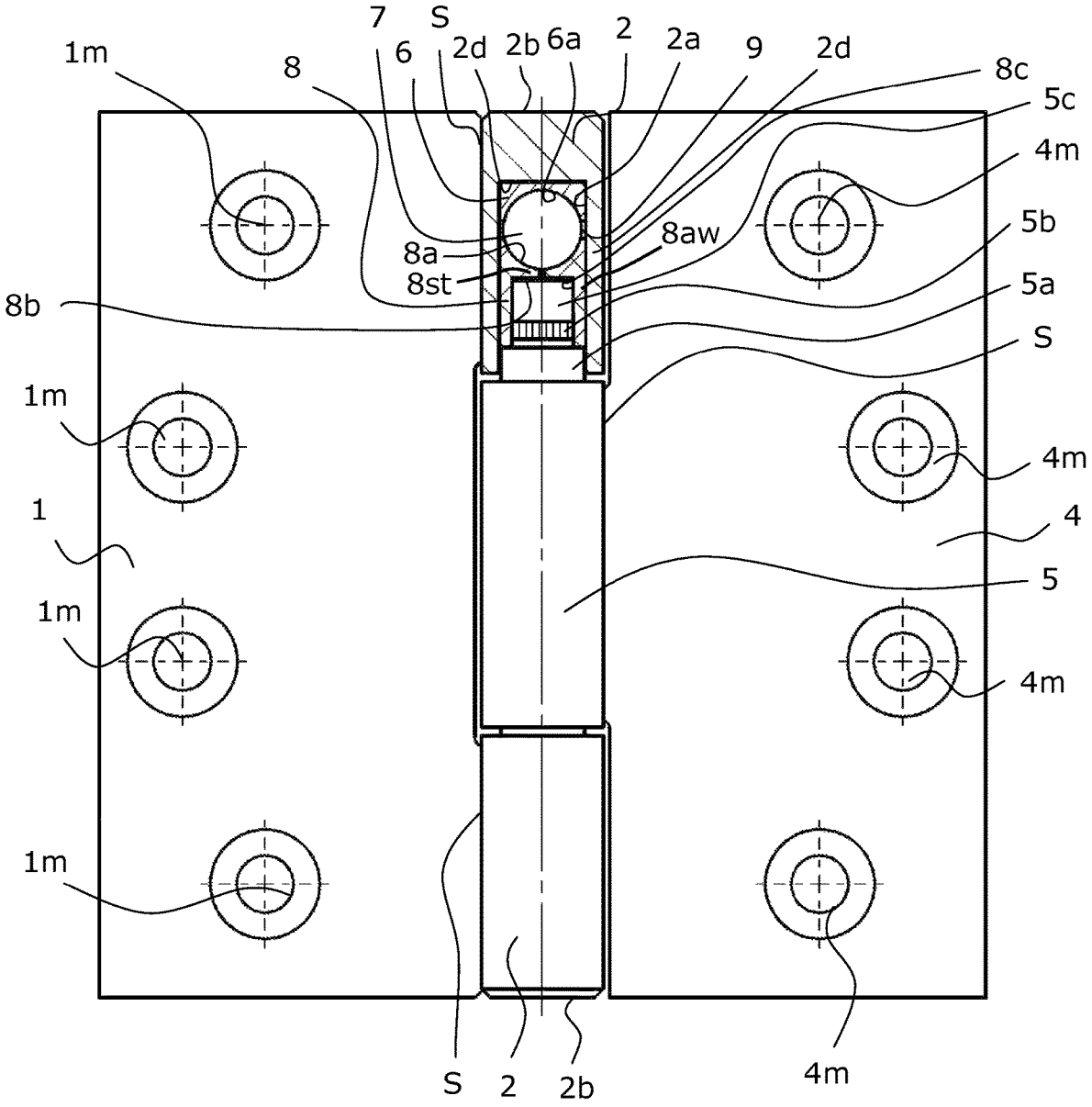
FIG. 1: sides and cross-section view of a finished door hinge according to the invention.

FIG. 1 shows a door hinge according to the invention consisting of the outer door hinge part, which is composed of the two bearing portions 2 and the outer hinge plate 1, wherein the bearing portions 2 are welded to the hinge plate 1 by means of the weld seams S. The inner door hinge part is formed by the hinge plate 4 and the bearing portion 5 welded thereto.

The bearing portions 2 of the outer door hinge part are cylindrical bodies which have an axial blind hole bore 2*a* with inner diameter $R_{i1}$, the bottom wall 2*d* of which is as flat as possible. Firstly, the sliding cup element 6, which is made of a suitable plastic, in particular is a plastic injection moulding part, is placed in the blind hole bore 2*a*. The first sliding cup element 6 has an inwardly curved, i.e. concave, ball socket-shaped end wall 6*a* which comes to rest on the ball 7 over as large a surface area as possible. The outer cylindrical wall of the first sliding cup element 6 also lies on the inner wall of the blind hole bore 2*a* over as large a surface area as possible.

The second sliding cup element 8 also has an inwardly curved, i.e. concave, ball socket-shaped end wall 8*a*, wherein the two ball socket-shaped walls 6*a*, 8*a* are formed such that the two sliding cup elements 6, 8 with the ball 7 arranged in between do not touch when the door hinge is assembled. The second sliding cup element 8 has, on its end face pointing towards the ball 7, a central recess 8*c* in which the cylindrical protrusion 5*b*, 5*c* of the corresponding bearing portion 5 engages, wherein the protrusion 5*b*, 5*c* rests with its end face 5*d* on the base wall 8*b* of the central recess 8*c*.

The cylindrical protrusion 5*b*, 5*c* has an outer diameter $R_{a2}$ which is less than or equal to the inner diameter $R_{i2}$ of the recess 8*c* of the second sliding cup element 8.

A further portion 5*a* is arranged between the cylindrical end 5*b*, 5*c* and the centre part 5*m*, and its outer diameter $R_{a1}$ is greater than the outer diameter of the ends 5*b*, 5*c*. The axial length of regions 5*a*, 5*b* and 5*c* and the arrangement of sliding cup elements 6, 8 and the ball is dimensioned such that the end wall of the centre part 5*m* does not hit against the bearing portions 2 of the outer door hinge part 1, 2.

The centre part 5*m* may have a recess 5*s* which in particular can be produced by means of a milling process, and in which the narrow side of the hinge plate 4 can be laid.

The region 5*b* may have an engrailed surface, so that the sliding cup element 8 can be pushed onto the end 5*b*, 5*c* and remain there captive, for easier assembly of the door hinge.

Figure 3:
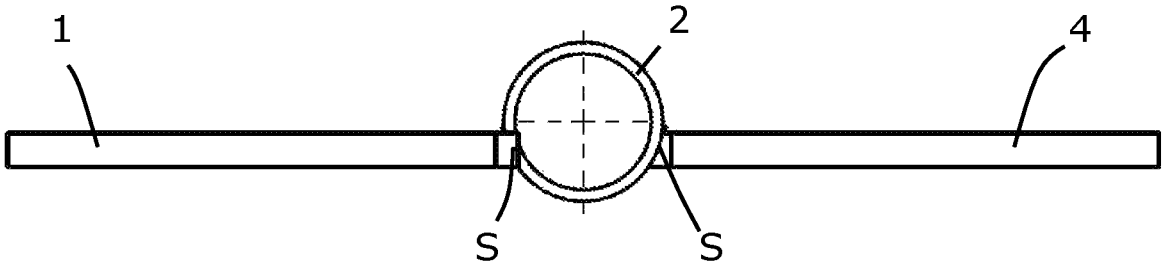
FIG. 3: top view of an open door hinge according to FIGS. 1 and 2.
Figure 4:
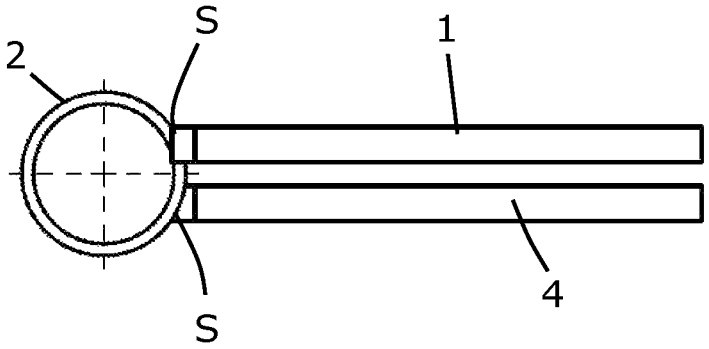
FIG. 4: top view of a closed door hinge according to FIGS. 1 and 2.

FIGS. 3 and 4 show top views of the door hinge in the opened and closed position respectively.

Figure 2:
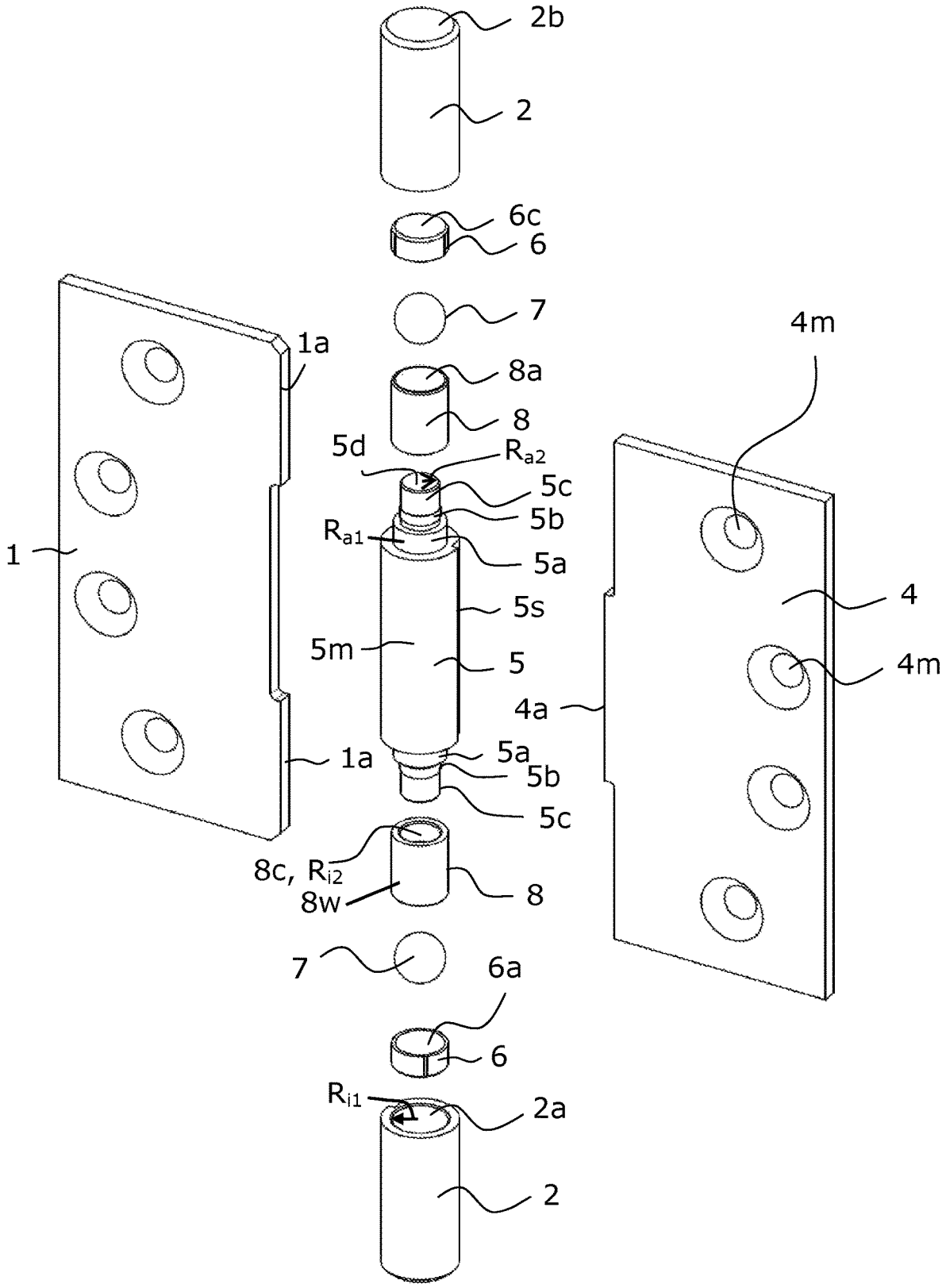
FIG. 2: exploded view of the door hinge according to FIG. 1.
Figure 5:
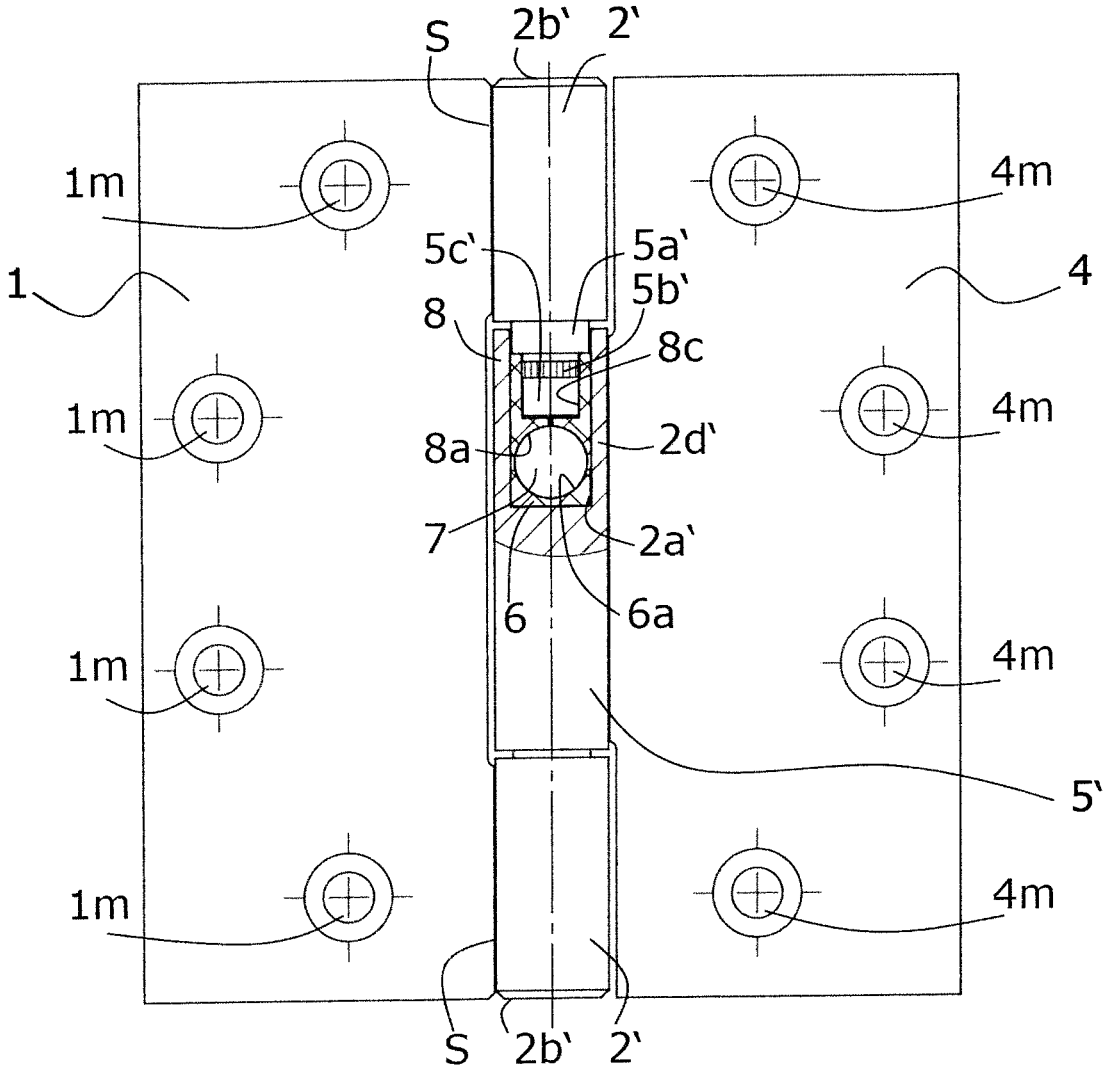
FIG. 5: sides and cross-section view of a finished door hinge, also according to the invention.
Figure 6:
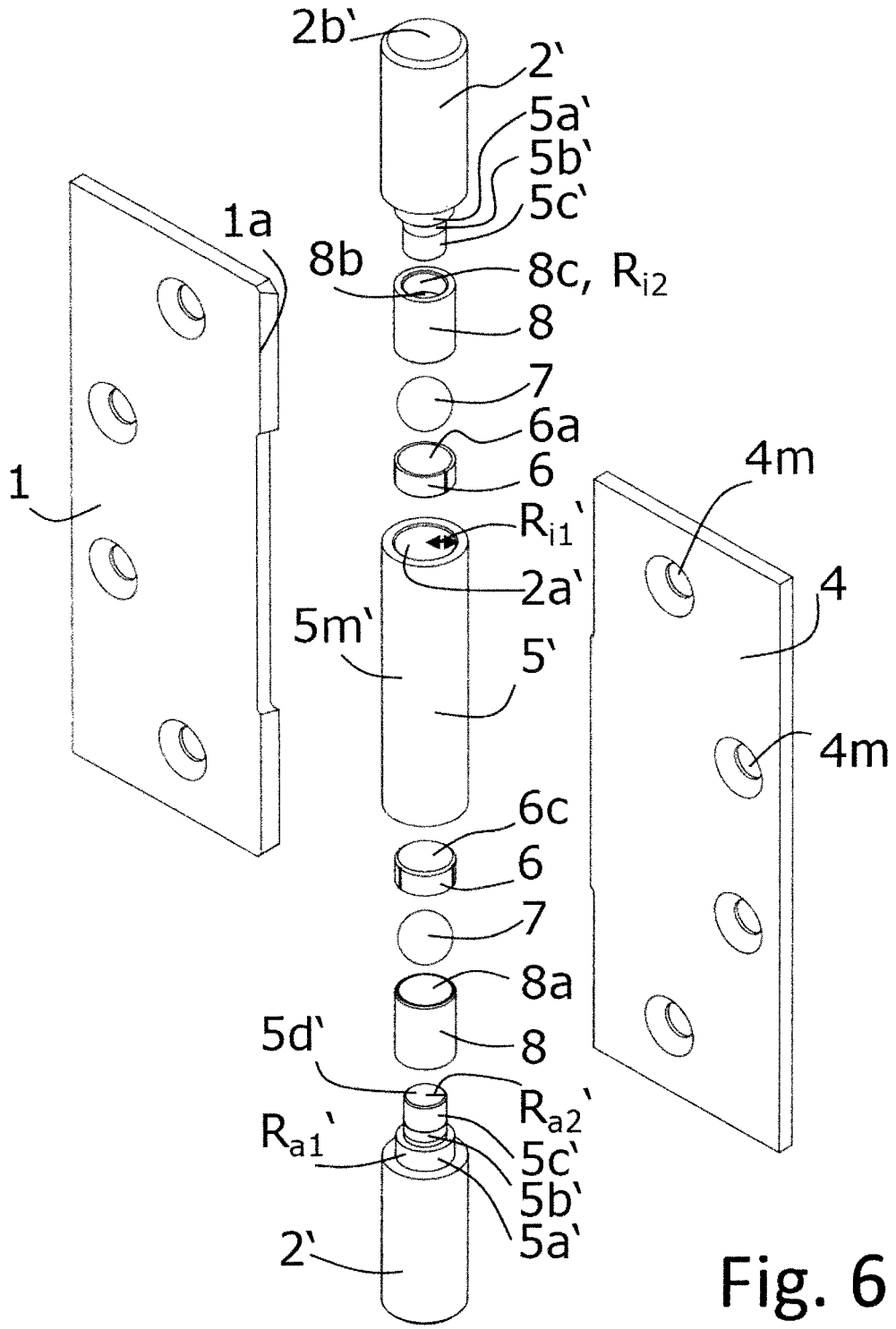
FIG. 6: exploded view of the door hinge according to FIG. 5.

A further embodiment of the invention is shown in FIGS. 5 and 6, in which like parts bear the same or similar reference numerals as those shown in FIGS. 1 and 2. In FIGS. 5 and 6, the bearing portion 5' of the inner door hinge part 4. 5' on both end faces has a recess in the form of a blind hole 2*a*' with a flat base, in each of which a first cylindrical sliding cup element, a ball and the second cylindrical sliding cup element lie 6, 7, 8. The bearing portions 2' of the outer door hinge part, on end faces pointing towards the bearing portion 5' of the inner door hinge part 4, 5', have respective protrusions 5*b*', 5*c*' configured to engage in the central recess 8*c* of the second cylindrical sliding cup element 8 of the inner door hinge part 5' and rest on the base wall of the central recess 8*c*.

What is claimed is:

1. A hinge, including:

an inner door hinge part and an outer door hinge part, wherein the inner and outer door hinge parts comprise fixing means in the form of hinge plates, for mounting to door frame and to door associated with the door frame, respectively, wherein the outer door hinge part comprises two bearing portions which are fixedly connected together by the fixing means, and wherein the inner door hinge part comprises one bearing portion which is arranged between two bearing portions of the outer door hinge part, wherein at least one of the bearing portions of the inner door hinge part or the outer door hinge part comprises:

an end face recess in the form of a blind hole with a flat base spanning an entire cross section of the blind hole and being formed integrally with a cylindrical wall of the at least one bearing portion of the inner door hinge part or the outer door hinge part, a first cylindrical sliding cup element lying in the blind hole with an end face outer wall superficially on the flat base of the blind hole, wherein the first cylindrical sliding cup element comprises a ball socket-shaped wall and a metal ball lying in the ball socket-shaped wall, and a second cylindrical sliding cup element lying fully or partly in the blind hole, wherein, on an end face of the second cylindrical cup element pointing towards the ball, the second cylindrical cup element has a concave ball socket-shaped wall lying superficially on a surface of the metal ball, wherein the second cylindrical sliding cup element, on an end face pointing away from the ball, has a central recess in which a cylindrical protrusion of an adjacent bearing portion of the inner door hinge part or the outer door hinge part is configured to engage, wherein the protrusion rests with an end face on a base wall of the central recess.

2. The door hinge according to claim 1, wherein each of the two bearing portions of the outer door hinge part has an end face recess in the form of a blind hole with a flat base, in each of which a respective first cylindrical sliding cup element, a respective ball and a respective second cylindrical sliding cup element lie, wherein each respective end of the bearing portion of the inner door hinge part forms a cylindrical protrusion configured to engage in a corresponding central recess of the second cylindrical sliding cup element of the outer door hinge part and rests on the base wall of the central recess.

3. The door hinge according to claim 1, wherein the bearing portion of the inner door hinge part on both end faces has a recess in the form of a blind hole with a flat base, in each of which a first cylindrical sliding cup element, a ball and the second cylindrical sliding cup element lie, wherein the bearing portions of the outer door hinge part, on end faces pointing towards the bearing portion of the inner door hinge part, have respective protrusions configured to engage in the central recess of the second cylindrical sliding cup element of the inner door hinge part and rest on the base wall of the central recess.

4. The door hinge according to claim 1, wherein the first and second cylindrical sliding cup elements are made of plastic.

5. The door hinge according to claim 1, wherein the second cylindrical sliding cup element has a cylindrical outer wall with constant outer diameter, wherein a first end face of the second cylindrical sliding cup element is formed by a ball socket-shaped wall which forms a bearing face for the metal ball, and a second end face end face of the second cylindrical sliding cup element has the central recess, including a flat base face.

6. The door hinge according to claim 5, wherein the base face and the ball socket-shaped end face are formed by a web-like wall or a collar pointing inward from a cylindrical wall.

7. The door hinge according to claim 1, wherein each of the two bearing portions of the outer door hinge part is formed by turned or rolled cylinders in which a blind hole bore with an inner diameter is machined.

8. The door hinge according to claim 7, wherein the bearing portion of the inner door hinge part has a cylindrical centre part, ends of which adjoin two cylindrical portions, the outer diameter of which two cylindrical portions is less and or equal to the inner diameter of the blind hole bores, wherein cylindrical protrusions adjoin the cylindrical portions axially and have an outer diameter which is less than or equal to an inner diameter of the central recess of the second cylindrical sliding cup element.

9. The door hinge according to claim 8, wherein an axial length of the respective cylindrical protrusions is greater than or equal to an axial depth of the central recess.

10. The door hinge according to claim 8, wherein a total axial length of parts lying on each other in a respective one of the blind hole bores, and consisting of the two cylindrical sliding cup elements, the ball and the cylindrical portions and cylindrical protrusions of the bearing portion of the inner door hinge, is longer than a depth of the blind hole bore, such that an end face of the cylindrical centre part does not lie on an end face of one of the two bearing portions of the outer door hinge part.

11. The door hinge according to claim 1, wherein at least one bearing portion of the inner or outer door hinge parts is produced by turning or cold extrusion.

12. The door hinge according to claim 1, wherein at least one or all bearing portions of the inner or outer door hinge parts is or are welded to a respective hinge plate.

13. The door hinge according to claim 1, wherein at least one of the hinge plates is configured for engagement in and cooperation with a door hinge receiver arranged in a frame or wall.

14. A method of production of the door hinge according to claim 8, the method including:

placing the first cylindrical sliding cup element, the ball and the second sliding element in each of the two respective bearing portions of the outer door hinge part, placing the two bearing portions on the two cylindrical protrusions of the bearing portion of the inner door hinge part, and pressing the bearing portions of the outer door hinge part against each other with a predefined force, and welding or soldering the bearing portions of the outer door hinge part to an outer one of the hinge plates and welding or soldering the bearing portion of the inner door hinge part to an inner one of the hinge plates.

15. The method according to claim 14, wherein during connection to the outer one of the hinge plates, the two bearing portions are pressed against each other with a predefined force which is sufficiently large for the inner and outer door hinge parts of the assembled door hinge to be pivotable or swivelable relative to each other only with a defined moment.

16. The method according to claim 15, wherein the predefined force is dimensioned such that after assembly of the door hinge, the door hinge parts are connected together free of play.

* * * * *